US006900824B2

(12) United States Patent
Glaeser

(10) Patent No.: US 6,900,824 B2
(45) Date of Patent: May 31, 2005

(54) PRINT TECHNOLOGY BASED ON HIGH ENERGY BEAMS

(75) Inventor: Axel Glaeser, Tauffelen (CH)

(73) Assignee: Neopost Industrie SA, Bagneux (FR)

( * ) Notice: Subject to any disclaimer, the term of this patent is extended or adjusted under 35 U.S.C. 154(b) by 0 days.

(21) Appl. No.: 10/159,907

(22) Filed: May 31, 2002

(65) Prior Publication Data

US 2003/0081109 A1 May 1, 2003

Related U.S. Application Data

(60) Provisional application No. 60/341,015, filed on Oct. 29, 2001.

(51) Int. Cl.[7] ..... B41J 2/44; B41J 2/447

(52) U.S. Cl. ..... 347/224

(58) Field of Search ..... 347/224, 225, 347/233, 236, 246, 254, 131, 193; 399/45

(56) References Cited

U.S. PATENT DOCUMENTS 3,971,956 A * 7/1976 Jakeman et al. ..... 250/559.16
4,019,066 A * 4/1977 Lucas et al. ..... 250/559.16
5,109,236 A * 4/1992 Watanabe et al. ..... 347/193
5,164,742 A * 11/1992 Baek et al.
5,689,757 A * 11/1997 Ferrante et al. ..... 399/45
6,437,817 B1 * 8/2002 Ohta et al. ..... 347/254
6,549,286 B2 * 4/2003 Komulainen et al. ..... 356/600
2002/0186415 A1 * 12/2002 Condon et al. ..... 358/3.06

FOREIGN PATENT DOCUMENTS

JP 62-080078 * 4/1987 ..... B41J/29/00
JP 3-99859 * 4/1991 ..... 400/679

* cited by examiner

*Primary Examiner*—Huan Tran
(74) *Attorney, Agent, or Firm*—Perman & Green, LLP.

(57) ABSTRACT

A system for printing on a print media. The device comprises at least one high energy emitting device and a parameter estimation device. The parameter estimation device is coupled to the high energy emitting device and is adapted to classify the print media and quantify an amount of energy per time to be emitted by the high energy emitting device during printing.

20 Claims, 3 Drawing Sheets

PRINT TECHNOLOGY BASED ON HIGH ENERGY BEAMS

CROSS-REFERENCE TO RELATED APPLICATIONS

This application claims priority from U.S. Provisional Patent Application No. 60/341,015, filed on Oct. 29, 2001.

BACKGROUND OF THE INVENTION

1. Field of the Invention

The present invention relates to printing devices and, more particularly, to printing with a high energy beam onto an object.

2. Brief Description of Related Developments

Printing on objects, such as for example a mail piece, generally comprises using an ink or inkjet style of printing technology. It would be helpful to reduce the consumption of material required for printing compared to today's ink jet technology (reasons: lower costs per imprint for the customer and fewer intervention cycles due to missing change of ink cartridges). It would also be of value to decrease the volume of a housing for a printing device to allow new designs and reductions in cost of goods sold due to less complicated mechanics. This is increasingly important in mail systems and franking machines.

SUMMARY OF THE INVENTION

The present invention is directed, in a first aspect to, a system for printing on a print media. In one embodiment the device comprises at least one high energy emitting device and at least one parameter estimation device. The parameter estimation device is coupled to the high energy emitting device and is adapted to classify the print media and quantify an amount of energy per time to be emitted by the high energy emitting device during printing.

In another aspect, the present invention is directed to a method of printing on a print media using at least one high energy emitting device. In one embodiment, the method comprises estimating a classification of a material of the print media and quantifying parameters like an amount of energy per time to be emitted by the high energy emitting device. An image is then printed onto the print media using the high energy emitting device, wherein the amount of energy per time delivered by the high energy emitting device is based on the classification of the material.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(s)

Figure 1:
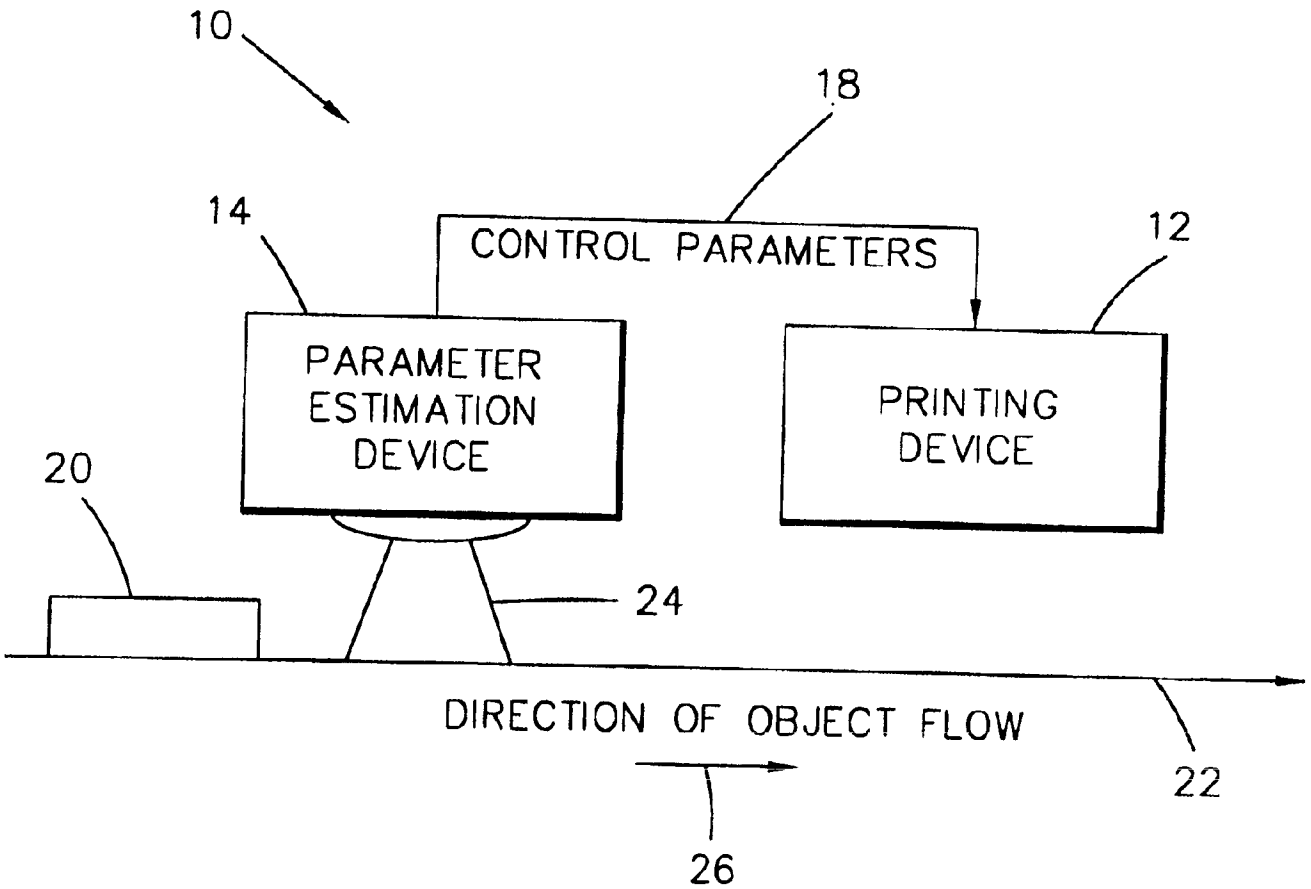
FIG. 1 is a block diagram of one embodiment of a printing system incorporating features of the present invention.

Referring to FIG. 1, a block diagram of a system 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Generally, as shown in FIG. 1, the system 10 comprises a printing device 12 and a parameter estimation device 14 ("PED"). The parameter estimation device could include for example, an energy estimation device adapted to evaluate the various parameters to deliver a suitable amount of energy to print on an object with a laser. Other parameters could be estimated by the parameter estimation device as well, including the focus of the energy beam, pulse width and thickness of the moving object.

The parameter estimation device 14 could also comprise one or more devices, each device adapted to measure or evaluate a specific parameter related to determining the amount of energy needed to produce readable marks on an object with the high energy device. In alternate embodiment, any suitable device or combination of devices could be used to evaluate the parameters of the object to be printed on, and the parameters of the energy beam. It is a feature of the present invention to be able to determine the properties of the surface to be printed on and the corresponding amount of energy needed to print a readable mark on the surface of an object.

In one embodiment, the printing device can comprise one or more high energy emitting devices ("HEED"). The HEED 12 generally adapted to produce readable marks on an object in a way that the marks cannot be detached from the object without notice. This can include printing, alternatively called burning, or even spraying an image onto a print media 20. The HEED 12 can comprise a single high energy emitting device or an array of high energy emitting devices. In an alternate embodiment, the system can include other suitable components or devices for printing information onto a surface of an object, such as for example a focused energy or high energy beam. It is a feature of the present invention to utilize a high energy emitting device to print information with a required resolution and speed on a surface of an object or printable media 20.

The HEED 12 can generally comprise a laser or laser array. In one embodiment, the printing device 12 comprises a one-dimensional array of high energy emitting devices. The energy beam from the printing device 12 can be focused in order to burn information of a required vertical (=orthogonal to the movement of the object) resolution, such as for example 200 dots per inch ("dpi"), on the object 20. The required horizontal (=in line with the movement of the object) resolution is guaranteed by the "firing" frequency of the HEED in relation to the speed of the moving object 20.

In one embodiment, the printing device 12 is adapted to move relative to the object 20 during a printing operation. For example, the printing device 12 comprising a single high energy emitting device can be moved in one dimension that is orthogonal to the movement of the object 20. The movement of the single high energy emitting device can be controlled mechanically or electronically.

The object 20 can comprise any suitable media having a printable surface. The object 20 can comprise for example, a letter or mail piece or any other media having a surface onto which information can be directly printed with a laser.

The parameters required for forming readable marks on the object 20, such as for example the amount of energy needed to be delivered by the print device 12 to the object 20, must be adapted to the object 20. For example, the amount of energy required for suitable printing needs to be adapted to the quality, color and thickness of the object 20 in order to avoid damaging the object on one side, while achieving a sufficient contrast and resolution on the other. As shown in FIG. 1, where the parameter estimated is energy, the energy estimation device 14 is positioned before, or earlier than the printing device 12 along a direction 26 of the object or letter flow. The parameter estimation device 14 is generally adapted to classify the material and surface characteristics (for example, smooth, rough, wrinkled) that comprises the object 20 and quantify parameters like the amount of energy needed to be emitted by the printing device 12. In one embodiment, the parameter estimation device 12 can estimate the optical reflection coefficient and the degree of roughness of the surface of the object 20. This estimation might be done in a spatial differentiated way, so that a two dimensional-array is analyzed and stored with the coefficients for the printable area. The parameter estimation device 12 of the present invention can determine the optical reflection coefficient and degree of roughness in a contact or contactless way. For example, one parameter measurement technique is positioning or contacting a roller on the object with a defined brake to measure the resulting torque, which is in direct correlation with the material properties. Once estimated or determined, the two parameters can be transferred to the printing device 12 to control parameters like the amount of energy per time required during printing. The energy per time generally equates to the energy per pixel. In one embodiment as shown in FIG. 1, the parameter estimation device 14 can generate at least one control parameter signal 18 that is fed to the printing device 12 based on the classification and properties of the material or surface of the object 20. The control parameter signal 18 is then used to control the energy required for printing.

As shown in FIG. 1, the parameter estimation device 14 is generally positioned ahead of, earlier or before the printing device 12 along the direction 26 of the object flow. In an alternate embodiment, the parameter estimation device or devices 14 can be positioned in any suitable location or locations to estimate the necessary parameters and control the printing. The printing device 12 prints directly onto an exposed surface of the object 20. This saves costs, but the print quality can be influenced by the surface material of the object 20 and variances in the surface of the object.

Figure 2:
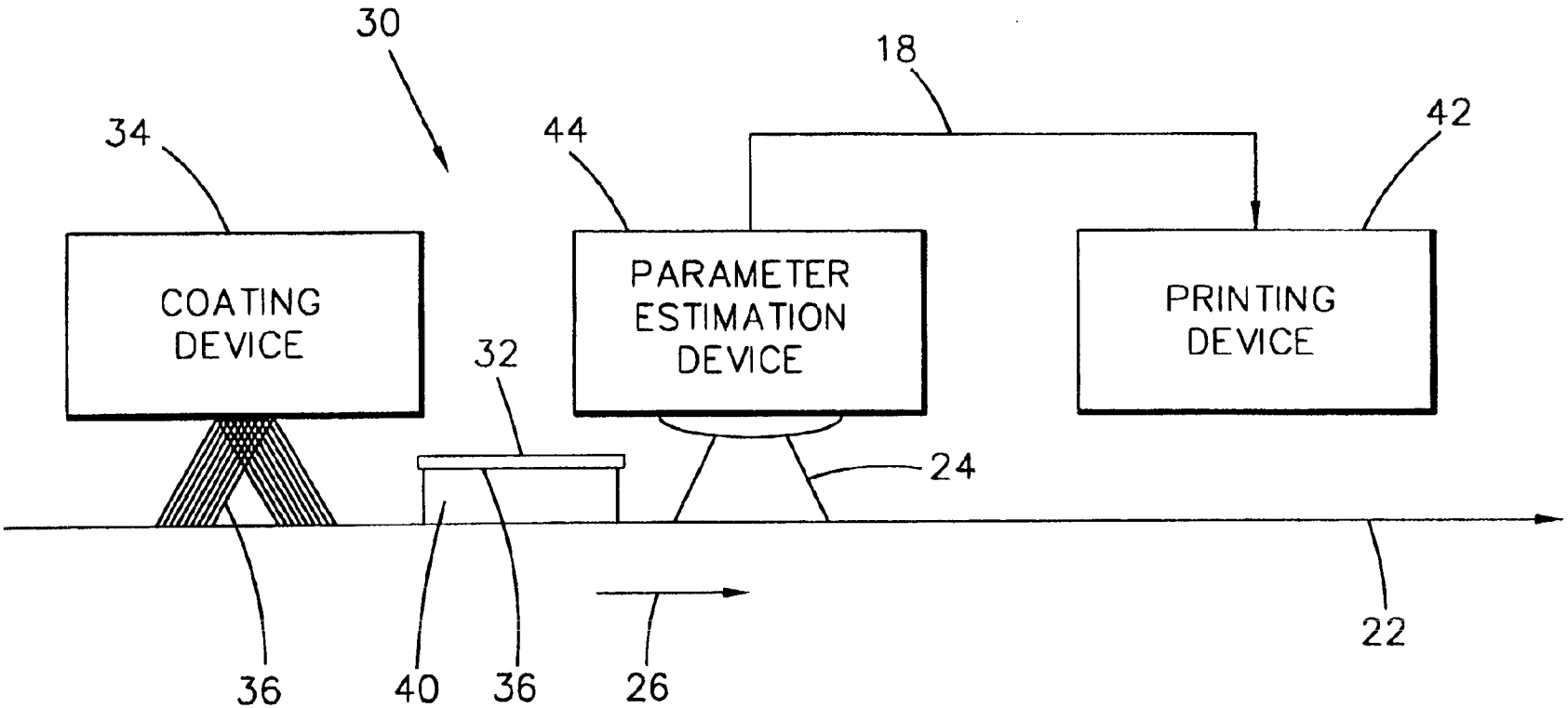
FIG. 2 is a block diagram of another embodiment of a printing system incorporating features of the present invention.

In one embodiment, referring to FIG. 2, the system 30 is adapted to unify the surface 32 of the object 40 prior to printing. Unifying the surface 32 can reduce the variances in the printable surface area. As shown in FIG. 2, a coating device 34 can be used to apply a coating or layer of a printable material 36 on a printing area 38 of the object 40. Preferably, the coating is a thin layer of a printable material 36 that attaches to a surface with relative ease and is sensitive to a HEED. In alternate embodiments, any suitable thickness of material can be used. The printing area 38 can be in any suitable location on the object or of any suitable size.

The coating should generally provide a more standardized surface for printing and allows for a less flexible printing device in terms of parameter and energy control. In alternate embodiments the coating could have any suitable properties, such as for example fluorescence to comply with the needs of the postal authorities if the object is a mail piece.

Figure 3:
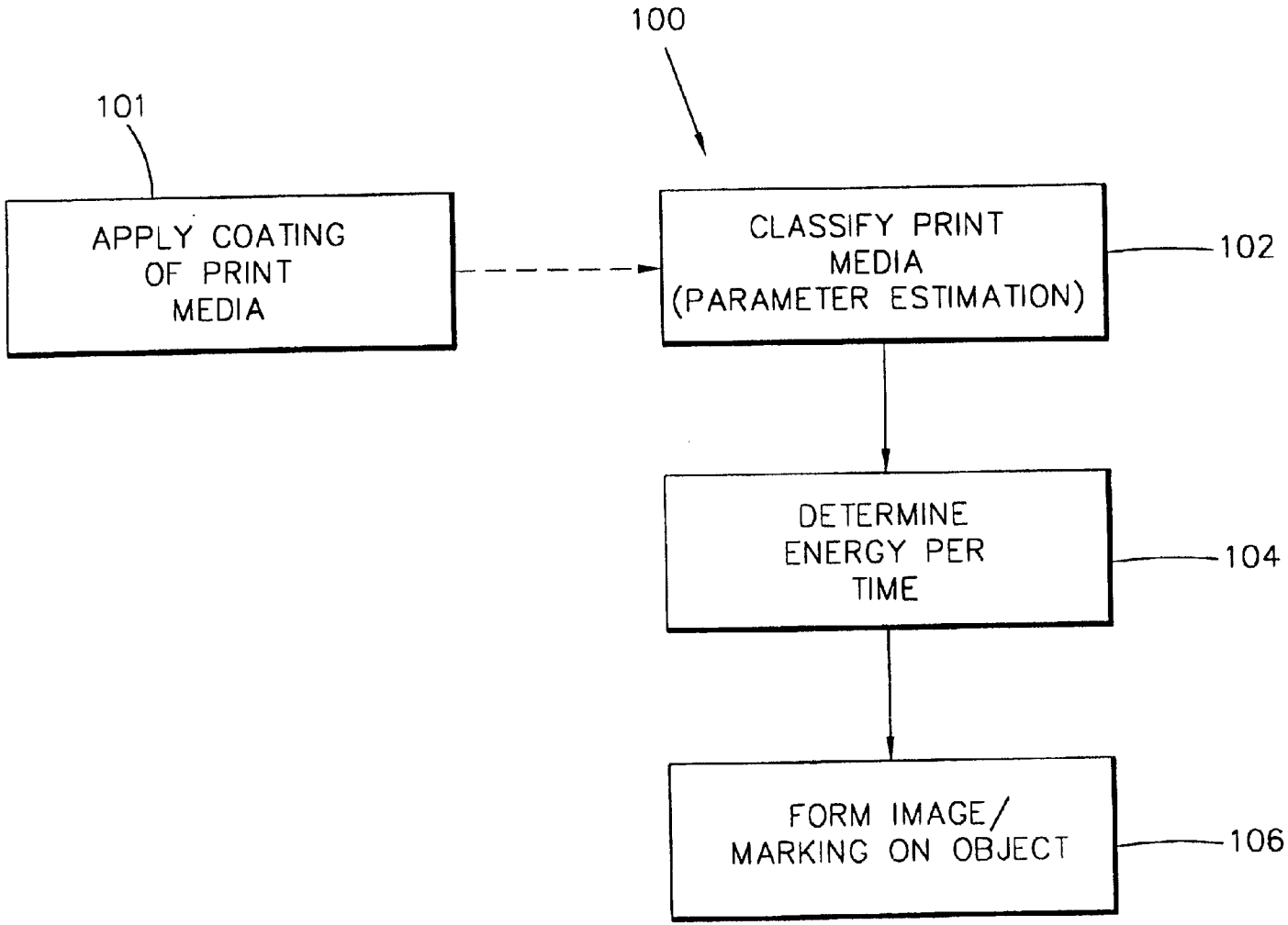
FIG. 3 is a flow chart illustrating one embodiment of a method for printing on an object incorporating features of the present invention.

In one embodiment, referring to FIG. 3, a method 100 of producing readable marks on an object using one or more high energy emitting devices is disclosed. In step 102, a classification of the print area on the print media is determined. The classification information, which can include the optical reflection coefficient and degree of roughness of the print media, is used to determine, in step 104, at least the amount of energy per time needed to be emitted by the high energy emitting device in order to mark the object. The step 104 of determining the energy per time could also take into account the focus of the energy beam, the pulse width of the energy and thickness of the surface of the moving object. In one embodiment, these additional parameters could be measured by the parameter estimation device as part of step 102, or in a separate step. The printing device then uses the estimated parameters including the amount of energy per time in order to form, which are generally delivered to the print device in the form of one or more control signals, in step 106, an image of a desired resolution on the object. In one embodiment the method can include coating, in step 101, the print area with a layer of a print media in order to regulate the printable surface.

The present invention generally provides a reduced consumption of material compared to ink jet technology by using a laser, a laser array or other focused high energy beam to produce a readable mark on an object. The present invention is able to print information with a required resolution on an object without damaging the object. The amount of energy required and delivered is regulated by an estimation of the parameters of the surface to be printed on and the parameters of the high energy device. The estimation can be accomplished by measuring the properties or the surface of the object relative to the parameters and properties of the high energy device. The measured properties can be correlated with the properties of the printing device in order to calculate the required amount of energy.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A system for printing on a print media comprising:

at least one high energy emitting device; and at least one parameter estimation device coupled to the high energy emitting device, the parameter estimation device adapted to classify the print media based on surface characteristics of the print media including a degree of roughness of the print media and quantify an amount of energy per time to be emitted by the high energy emitting device during printing and estimate an optical reflection coefficient of the print media and quantify parameters like the amount of energy to be emitted by the high energy emitting device based on the estimate.

2. The system of claim 1 wherein the high energy emitting device is a one-dimensional array of emitting devices.

3. The system of claim 1 wherein the high energy emitting device is a single unit adapted to move in one dimension orthogonal to a movement of the print media.

4. The system of claim 1 wherein the high energy emitting device is adapted to move in a horizontal or a vertical direction.

5. The system of claim 1 wherein the parameter estimation device is positioned prior to the high energy emitting device along a direction of movement of the print media on a transport medium.

6. The system of the claim 1, wherein the parameter energy estimation device is adapted to estimate a degree of roughness of the print media and quantify the amount of energy to be emitted by high energy emitting device based on the estimate.

7. The system of the claim 1 wherein parameter estimation device does not make physical contact with the print media.

8. The system of claim 1 wherein the parameter estimation device further includes a sensor adapted to make physical contact with the print media to estimate certain parameters of the print media.

9. The system of claim 1 wherein the at least one high energy emitting device is a laser.

10. The system of claim 1 wherein the print media is moving on a transport medium.

11. The system of claim 1 wherein the surface characteristics are smooth, rough or wrinkled.

12. The system of claim 1 wherein the surface characteristic includes an optical reflection coefficient of the print media.

13. The system of claim 1 wherein the surface characteristics of the print media are a color, thickness or quality of the print media.

14. A system for printing on a print media comprising:

at least one high energy emitting device;

at least one parameter estimation device coupled to the high energy emitting device, the parameter estimation device adapted to classify the print media and quantify an amount of energy per time to be emitted by the high energy emitting device during printing; and a coating device adapted to apply a layer of a printable material on a print area of the print media, the layer of the printable material being sensitive to the high energy emitting device.

15. The system of claim 14 wherein the layer of printable material includes a layer of a coating material which contains additional properties for recognition systems like fluorescence.

16. A method of printing on a print media using at least one high energy emitting device comprising the steps of:

estimating a classification of a material of the print media and quantifying parameters like an amount of energy per time to be emitted by the high energy emitting device, the step of estimating a classification of the material further comprising the steps of:

estimating an optical reflection coefficient of the material;

estimating a degree of roughness of the material;

estimating the brightness of the material to control a contrast regulation; and printing an image onto the print media using the high energy emitting device, wherein the amount of energy per time delivered by the high energy emitting device during printing is based on the classification of the material.

17. The method of claim 16 wherein the high energy emitting device is a one-dimensional array and the step of printing further includes the step of moving the array in one-dimension orthogonal to a direction of movement of the print media.

18. A method of printing on a print media using at least one high energy emitting device, comprising the steps of:

estimating a classification of a material of the print media and quantifying parameters like an amount of energy per time to be emitted by the high energy emitting device;

coating a layer of a printable material on a print area of the print media the layer of the printable material being sensitive to the high energy emitting device; and printing an image onto the print media using the high energy emitting device, wherein the amount of energy per time delivered by the high energy emitting device during printing is based on the classification of the material.

19. A system for printing on a print media comprising:

at least one high energy emitting device;

at least one parameter estimation device coupled to the high energy emitting device, the parameter estimation device adapted to classify the print media based on surface characteristics of the print media including a degree of roughness of the print media and quantify an amount of energy per time to be emitted by the high energy emitting device during printing; and wherein the parameter estimation device further includes a sensor adapted to make physical contact with the print media to measure a resulting torque when the sensor contacts the print media.

20. A system for printing on a print media comprising:

at least one high energy emitting device;

at least one parameter estimation device coupled to the high energy emitting device, the parameter estimation device adapted to classify the print media based on surface characteristics of the print media including a degree of roughness of the print media and quantify an amount of energy per time to be emitted by the high energy emitting device during printing; and wherein the surface characteristics includes an optical reflection coefficient of the print media.

* * * * *